US005331113A

United States Patent [19]

Soni et al.

[11] Patent Number: 5,331,113

[45] Date of Patent: Jul. 19, 1994

[54] ELECTRICAL CONNECTOR

[75] Inventors: Pravin L. Soni, Union City; Mohamed H. Higgy, Redwood City, both of Calif.

[73] Assignee: Raychem Corporation, Menlo Park, Calif.

[21] Appl. No.: 968,651

[22] Filed: Oct. 30, 1992

[51] Int. Cl.[5] ..... H01R 4/02; H01R 43/02

[52] U.S. Cl. ..... 174/87; 29/872; 174/84 R; 174/DIG. 8

[58] Field of Search ..... 174/87, 84 R, DIG. 8; 29/859, 868, 872

[56] References Cited

U.S. PATENT DOCUMENTS

| | | | |
|---|---|---|---|
| 2,027,962 | 1/1936 | Currie | 18/55 |
| 3,086,242 | 4/1963 | Cook et al. | 18/1 |
| 3,243,211 | 3/1966 | Wetmore . | |
| 3,597,372 | 8/1971 | Cook | 260/4 |
| 4,018,733 | 4/1977 | Lopez et al. | 260/27 |
| 4,035,577 | 7/1977 | Loeber | 174/84 |
| 4,181,775 | 1/1980 | Corke | 428/348 |
| 4,282,396 | 8/1981 | Watine et al. | 174/84 R |
| 4,283,596 | 8/1981 | Vidakovits et al. | 174/84 R |
| 4,654,473 | 3/1987 | Roux et al. | 174/84 R |
| 4,722,471 | 2/1988 | Gray et al. | 228/265 |
| 4,832,248 | 5/1989 | Soni et al. | 174/84 R X |
| 4,883,921 | 11/1989 | Legerius et al. | 174/87 |
| 4,940,179 | 7/1990 | Soni | 174/84 R |
| 5,052,610 | 10/1991 | Guerra et al. | 174/DIG. 8 |

FOREIGN PATENT DOCUMENTS

| | | |
|---|---|---|
| WO92/14279 | 8/1982 | PCT Int'l Appl. . |
| WO92/00616 | 1/1992 | PCT Int'l Appl. . |
| WO88/09068 | 11/1988 | World Int. Prop. O. . |
| WO90/09255 | 8/1990 | World Int. Prop. O. . |
| WO91/11831 | 8/1991 | World Int. Prop. O. . |

*Primary Examiner*—Morris H. Nimmo

*Attorney, Agent, or Firm*—Sheri M. Novack; Herbert G. Burkard

[57] ABSTRACT

A device for forming an electrical connection between a number of electrical wires comprises an electrically insulating sleeve and a hollow connecting element, for example in the form of a coil, which is formed from solder for forming a solder joint between the wires. The connecting element has a tapering internal surface that is provided with a screw thread, for example by means of the coil windings, arranges so that a temporary electrical connection may be formed between the conductors by twisting them into the connecting element. The device can be higher and, when installed have reduced size compared with connectors that are provided with infusible connecting elements.

19 Claims, 2 Drawing Sheets

ELECTRICAL CONNECTOR

BACKGROUND OF THE INVENTION

This invention relates to electrical connectors and especially to connectors for forming solder connections between elongate electrical conductors.

Electrical connectors which contain solder inserts are widely used for forming solder connections between elongate electrical conductors. Such connectors are described in U.S. Pat. Nos. 3,243,211, 4,282,396 and 4,283,596 and International Patent Application Publication No. WO91/11831, the disclosures of which are incorporated herein by reference. Such electrical connectors are satisfactory for most applications, but in some situations they suffer from the drawback that it is normally possible for the elongate conductors (e.g. wires) to slip out of the connector prior to the formation of the solder connection.

In the manufacture of automotive harnesses, for example, it is usual to assemble the harness and form temporary connections between the wires and cables so that an electrical current or signal may be passed through the assembly in order to verify that the harness has been assembled correctly. It is only after such verification is obtained that permanent electrical connections are formed. The electrical connectors mentioned above are often unsatisfactory for such an application, because they generally cannot be used to form temporary joints which are dependable so that the harness can be tested prior to formation of the permanent solder joint.

The electrical connectors described in International Patent Application No. WO92/00616 overcome the above drawbacks. These devices contain a metallic connecting element, made from copper for example, having a tapering internal surface which has a screw thread, so that a temporary electrical connection between a bundle of wires can be formed by screwing them into the connecting element. They also contain a solder insert for forming a permanent connection between the wires, so that, for example, once an automotive harness has been tested using temporary connections, these connections can be made permanent simply by heating the connectors so as to melt the solder and form solder connections. Whilst these connectors perform excellently they have the drawback that because the solder joint is formed inside the connecting element it is difficult to inspect. In addition, in comparison to a connection formed entirely by solder, the presence of the connecting element normally raises the weight of the connection and also its size, for example due to the protrusion of a circumferentially extending ridge in the area of the connection.

SUMMARY OF THE INVENTION

According to a first aspect of the invention, there is provided a device for forming an electrical connection between a plurality of elongate electrical conductors, which comprises an electrically insulating sleeve and a hollow connecting element contained within the sleeve, the connecting element formed from solder for forming a solder connection between the conductors and having a tapering internal surface that is provided with a screw thread, arranged so that a temporary electrical connection between the conductors may be formed by twisting them into the connecting element.

According to a second aspect of the invention there is provided a device for forming an electrical connection between a plurality of elongate electrical conductors which comprises an electrically insulating sleeve and a hollow connecting element contained within the sleeve, the connecting element comprising a tapering coil of solder wire for forming a solder connection between the conductors, the solder wire having at least one ridge extending helically along at least part of its length, arranged so that a temporary electrical connection between the conductors may be formed by twisting them into the coil.

According to a third aspect of the invention, there is provided a method of forming an electrical connection between a plurality of elongate electrical conductors by means of a device according to the invention, which comprises:

(a) twisting the elongate electrical conductors into the solder connecting element of the device, thereby forming a temporary electrical connection between the conductors;

(b) heating the device so that at least some of the solder of the connecting element melts; and (c) allowing the device to cool so that the molten solder solidifies and forms a solder connection between the conductors.

The method may additionally include passing an electrical current through the temporary electrical connection prior to heating the device, for example in order to verify the connection.

The invention has a number of advantages. Devices according to the invention are normally lighter than similar devices which contain both a connecting element that is not formed from solder and a solder insert, while still allowing verification of the connection before heating for example. This can be significant for applications where weight minimisation is important, such as in aircraft for example. As well as normally being lighter than such devices, devices according to the invention are often capable of forming less bulky electrical connections, since once the solder has melted the original connecting element has 'disappeared' and has been replaced by a simple solder connection. In addition, in embodiments of the invention in which at least part of the insulating sleeve is transparent the quality of the finished solder connection may normally be inspected. This is in contrast to most connector devices which contain a solder insert located inside a connecting element.

DETAILED DESCRIPTION OF THE INVENTION

Figure 1:
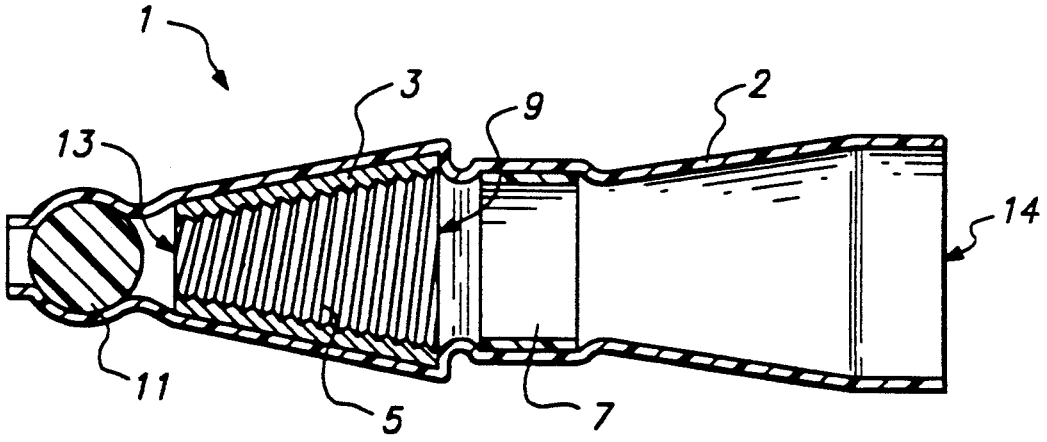
FIG. 1 is a sectional elevation along the axis of a device according to the present invention.

The devices according to the invention include an electrically insulating sleeve. Usually the sleeve will be dimensionally recoverable, and especially dimensionally heat-recoverable, that is to say an article which has a dimensional configuration which may be made substantially to change when subjected to heat treatment. Usually, such articles recover, on heating, towards an original shape from which they have previously been deformed, but the term heat-recoverable, as used herein, also includes articles which, on heating, adopt a new configuration, even if they have not previously been deformed.

The heat-recoverable sleeve may comprise a heat shrinkable article made from a polymeric material exhibiting the property of elastic or plastic memory as described, for example, in U.S. Pat. Nos. 2,027,962; 3,086,242 and 3,597,372. As is made clear in, for example U.S. Pat. No. 2,027,962, the original dimensionally heat-stable form may be a transient form in a continuous process in which, for example, an extruded tube is expanded, whilst hot, to a dimensionally heat-unstable form, but, in other applications, a preformed dimensionally heat-stable article is deformed to a dimensionally heat-unstable form in a separate state.

Any material to which the property of dimensional recoverability may be imparted may be used to form the sleeve. Preferred materials include: low, medium or high density polyethylene; ethylene copolymers, e.g. with alpha olefins such as 1-butene or 1-hexene, or vinyl acetate; polyamides, especially Nylon materials, e.g. Nylon 6, Nylon 6.6, Nylon 11 or Nylon 12; and fluoropolymers, e.g. polytetrafluoroethylene, polvinylidenefluoride, ethylenetetrafluoroethylene copolymer or vinylidenefluoride tetrafluroethylene copolymer.

As mentioned above, according to a first aspect of the invention the connecting element of the device has a tapering internal surface that is provided with a screw thread, arranged so that a temporary electrical connection between a plurality of elongate electrical conductors may be formed by twisting them into the connecting element. The connecting element may, for example, be formed from a hollow solder preform, preferably having a substantially conical or frusto-conical interior. More preferably the solder preform itself has a substantially conical or frusto-conical shape. The screw thread may be formed in any one of a number of conventional ways, but preferably it is formed by stamping.

According to certain preferred embodiments of the invention, the connecting element of the device is formed from a tapering coil of solder wire. The solder wire may generally have any cross-section which will allow a temporary electrical connection to be formed between a plurality of elongate electrical conductors by twisting them into the tapering coil. Preferably, however, the cross-section of at least part of the wire is such that the wire has at least one ridge extending along at least part of its length. More preferably at least part of the solder wire has a substantially polygonal, especially rhombic, cross-section, and the angular portions of the cross-section may form ridges extending along at least part of the length of the wire.

When the connecting element according to the first aspect of the invention is formed from a tapering coil of solder wire, the screw thread of the connecting element is preferably formed from at least one ridge extending along at least part of the length.

As already mentioned, a temporary electrical connection between a plurality of elongate electrical conductors may be formed by twisting them into the connecting element of a device according to the first aspect of the invention. It is possible that the action of twisting the conductors into the tapering internal surface of the connecting element normally causes the conductors to twist about themselves to a degree. Subsequent accidental removal of the conductors is normally inhibited, possible because the twisted conductors are caught within various parts of the screw thread. It has been found that particularly reliable temporary connections may often be formed when stranded conductors are used, presumably because the strands themselves may be twisted and may therefore be caught within parts of the screw thread.

In a particularly preferred embodiment of the device according to the first aspect of the invention, the screw thread of the connecting element is periodically interrupted along at least part of its length. These interruptions may, for example, take the form of indentations, and preferably substantially 'V' or 'U' shaped or rectangular indentations in the teeth of the screw thread. Where the connecting element is formed from a coil of solder wire, the wire may be provided with a number of interruptions which also preferably take the form of indentations which preferably substantially 'V' or 'U' shaped or rectangular when viewed from the side of the wire. The grooves may be located next to one another so that they 'touch' or they may be separated from one another to a greater or lesser extent. Where the connecting element is formed from a hollow solder preform the interrupted screw thread may, for example, be formed by stamping and where it is formed from a coil of solder wire the interruptions may, for example, be formed in the wire by means of a toothed roller.

Providing the screw thread of the connecting element with periodic interruptions along at least part of its length may often improve the reliability of temporary electrical connections formed by means of the device. It is possible that this is because the degree to which the conductors are twisted about themselves is increased since the conductors become caught in the interruptions in the screw thread when they are twisted into the connecting element.

As mentioned above, the hollow connecting element of the device according to the second aspect of the invention comprises a tapering coil of solder wire, the wire having at least one ridge extending helically along at least part of its length, arranged so that a temporary electrical connection between a plurality of elongate electrical conductors may be formed by twisting them into the coil. The solder wire according to this aspect of the invention may be formed in a number of different ways. For example, the wire may be drawn in order to form it into the required thickness and also in order to provide it with at least one ridge extending along at least part of its length, and subsequent to this the drawn wire may be twisted in order to cause the or each ridge to extend helically. Alternatively for example, the or each ridge in the wire may be caused to extend helically at the same time as the wire is drawn, either by twisting the wire as it passes through the draw plate or by rotating the draw plate itself.

It is believed that the connecting element of the device according to the second aspect of the invention may provide temporary electrical connections in a similar way to that of the device according to the first aspect of the invention wherein the screw thread is periodically interrupted along its length. It is possible that the helically extending ridge(s) of the solder wire may act as periodic protrusions on the inside of the wire coil which may increase the degree of twisting of the elongate electrical conductors about themselves when they are twisted into the coil. Subsequent accidental removal of the conductors is normally inhibited possibly because the twisted conductors are caught between the protrusions and/or the windings of the wire coil.

The connecting element of the device according to the second aspect of the invention may be formed so that the coil of the solder wire and the helix or helices of the or each ridge extending along at least part of the length of the wire have the same or opposite handedness.

The devices according to the first and second aspects of the invention include, respectively: a hollow solder connecting element having a tapering internal surface provided with a screw thread; and a hollow connecting element comprising a tapering coil. Each of these devices may be used to form a stub splice between a plurality of elongate electrical conductors inserted into one end of the insulating sleeve, the other end of the sleeve for example being closed, especially be means of a sealing ball as described in International Patent Application No. WO91/11831, the disclosure of which is incorporated herein by reference. Alternatively, however, the internal surface of the connecting element or the coil of solder wire respectively may taper in two opposite directions to an intermediate region of minimum diameter, for example in a 'diabolo' shape. These forms of device may therefore be used to form in-line splices between a plurality of elongate electrical conductors. Other forms of device according to the invention may also achieve this purpose; according to these embodiments of the invention the device may include respectively: a second solder connecting element having a tapering internal surface that is provided with a screw thread connected to the first connecting element by connecting means; or a second connecting element comprising a second tapering coil of solder wire connected to the first coil of solder wire by connecting means. The connecting means may take any appropriate form, for example it may comprise a substantially cylindrical element that is provided with two or more protrusions or grooves which are capable of interlocking with the two connecting elements. It is possible for the two connecting elements to be rotatable with respect to each other and/or for the two coils or screw threads respectively to have the same or opposite handedness.

The solder of the connecting element of the devices according to the invention may comprise any one or more appropriate solder compositions. For example, it may be formed from an $Sn_{63}$ $Pb_{37}$ or an $Sn_{96.5}$ $Ag_{3.5}$ eutectic composition. In embodiments of the invention where the connecting element comprises a hollow solder preform, the preform may for example comprise a composite having a portion that is formed from a relatively high melting point solder and a portion that is formed from a relatively low melting point solder, as described in International Publication No. WO88/09068. In this form of device, melting of the higher melting point component e.g. $Sn_{96.5}$ $Ag_{3.5}$ eutectic will normally provide a visual indication that the device has been heated sufficiently to melt the lower melting point component and to form a satisfactory solder joint. If desired, the lower melting point component may be of non-eutectic composition and, for example as described in International Publication No. WO90/09255, the higher and lower melting point components may together form a eutectic composition. For example, a non-eutectic $Sn_{60}$ $Pb_{40}$ lower melting point component may be employed with a higher melting point component formed from pure tin in relative amounts such that an $Sn_{63}$ $Pb_{37}$ eutectic is formed. The disclosures of these two patent applications are incorporated herein by reference. An advantage of employing a two component solder, and especially a tin, $Sn_{60}$ $Pb_{40}$ combination is that it reduces the possibility of 'wicking', that is to say, travel of solder away from the joint area due to capillary action, which can be caused by prolonged heating of the device.

The solder connecting element of the device according to the invention may advantageously be provided with a core of flux. In embodiments of the invention where the connecting element comprises a tapering coil of solder wire, it is particularly preferred that at least part of the solder wire is hollow along its length and contains a quantity of flux.

In preferred embodiments of the invention, the sleeve of the devices contains a quantity of fusible polymeric material. The fusible polymeric material may, for example, be present in order to seal an electrical connection formed by means of the device from moisture ingress and/or it may be present in order to provide strain relief to the connection. The material may be present in the form of at least one insert having any one of a variety of shapes, such as for example a ball, a pellet or a ring.

The fusible polymeric material according to the invention preferably comprises a thermoplastic material, for example a hot-melt adhesive. The material may, for example, be formed from an olefin homopolymer or from a copolymer of an olefin with other olefins or ethylenically unsaturated monomers. Preferred examples include high, medium or low density polyethylene or ethylene copolymers with alpha olefins, especially C3 to C8 alpha olefins, vinyl acetate or ethyl acrylate. Alternatively, the material may be formed from polyamides, polyesters, halogenated polymers and the like. Preferred polyamides include those having an average of at least 15 carbon atoms between amide linkages, for example those based on dimer acids and/or dimer diamines. Examples of such adhesives are given in U.S. Pat. Nos. 4,018,733 to Lopez et al and 4,181,775 to Corke, the disclosures of which are incorporated herein by reference.

Four forms of device according to the invention will now be described by way of example with reference to the accompanying drawings.

FIG. 1 shows a device 1 for forming an electrical connection between a plurality of elongate electrical conductors, which comprises an electrically insulating sleeve 2 containing a hollow connecting element 3 formed from solder, which has a tapering internal surface that is provided with a screw thread 5, a ring of fusible polymeric material 7 located inside the sleeve beyond a relatively wide open end 9 of the connecting element and a sealing ball 11 located inside the sleeve beyond a relatively narrow end 13 of the connecting element, the sealing ball sealing one end of the sleeve.

The connecting element 3, which is for forming a solder connection between the elongate conductors, comprises a hollow substantially frusto-conical preform of $Sn_{63}$ $Pb_{37}$ eutectic alloy. The insulating sleeve 2, which is formed from crosslinked and expanded polyvinylidene fluoride, is dimensionally heat-recoverable and has an open end 14. The sealing ball 11 is formed from irradiated or non-irradiated polyethylene, and the ring of fusible polymeric material 7 is formed from a polyamide composition.

Figure 2:
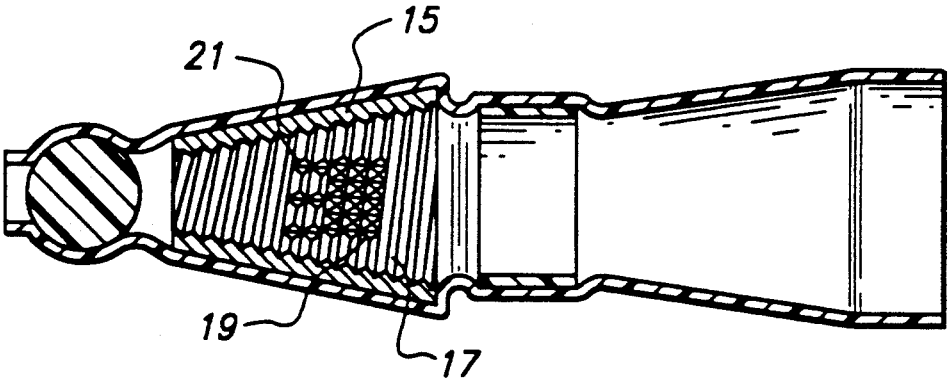
FIG. 2 is a sectional elevation along the axis of a second form of device according to the present invention.
Figure 3:
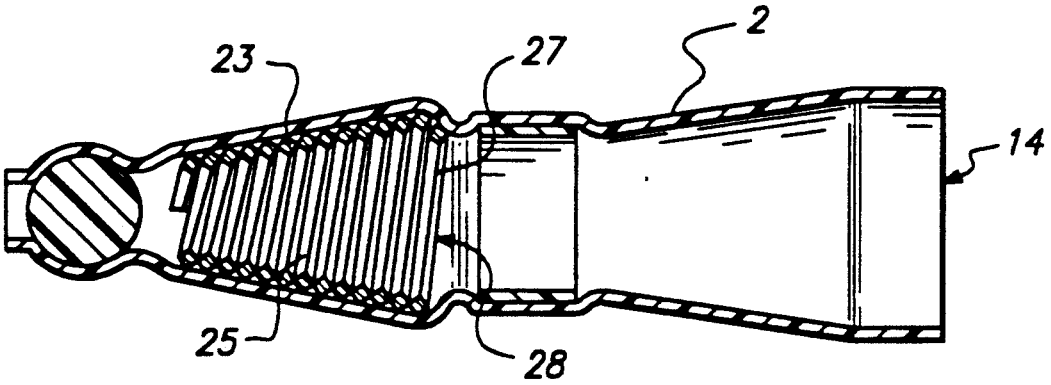
FIG. 3 is a sectional elevation along the axis of a third form of device according to the invention.
Figure 4:
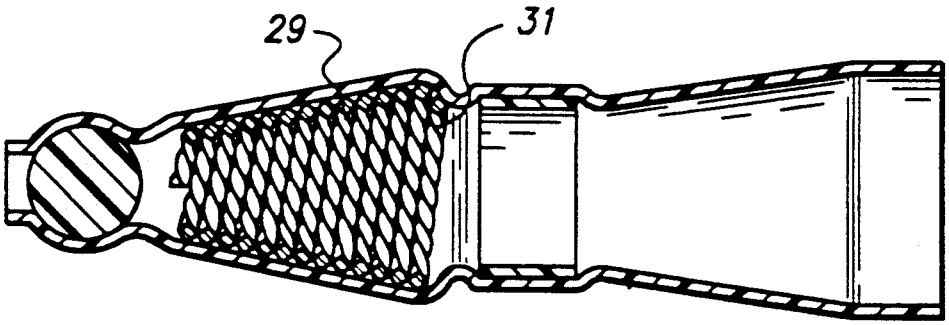
FIG. 4 is a sectional elevation along the axis of a fourth form of device according to the invention.

FIGS. 2, 3 and 4 each show a further form of device according to the invention. These devices are similar to that shown in FIG. 1, the only difference in each being the type of connecting element used.

In FIG. 2, the connecting element 15 is identical to the connecting element 3 of FIG. 2 with the exception that its screw thread is periodically interrupted along at least part of its length by 'V' shaped indentations 19 and 21. Only a few of the indentations 19 and 21 are shown in the drawing. The indentations indicated 19 are shown in order to illustrate indentations which are 'touching' and those indicated 21 to illustrate indentations which are separated from one another.

The connecting element 23 shown in FIG. 3 comprises a tapering coil of substantially square cross-section solder wire. The screw thread 25 of the connecting element is formed from a ridge 27 extending along the length of the wire, the ridge itself comprising an inwardly-directed angular portion of the square cross-section wire.

The connecting element 29 of the device shown in FIG. 4 also comprises a tapering coil of substantially square cross-section solder wire. However, in this device the square cross-section solder wire is twisted so that it has four ridges 31, corresponding to the four right angles of its cross-section, extending helically along its length.

Figure 5:
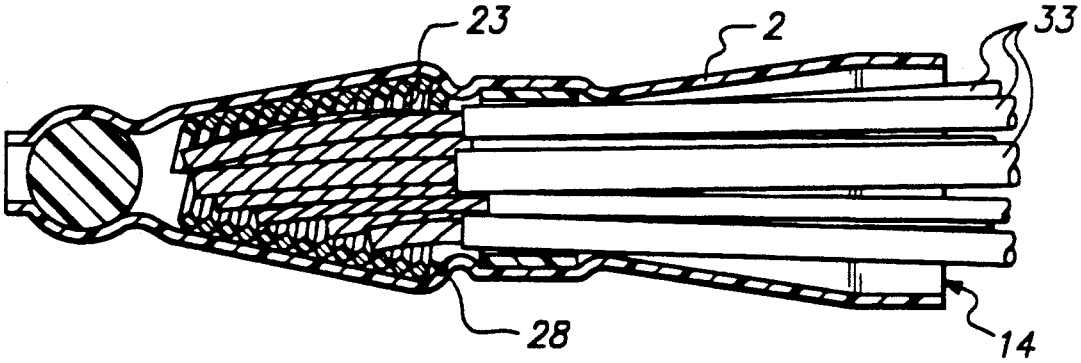
FIG. 5 is a sectional elevation along the axis of a temporary electrical connection between a plurality of stranded wires which has been formed by twisting the wires into the device shown in FIG. 3.
Figure 6:
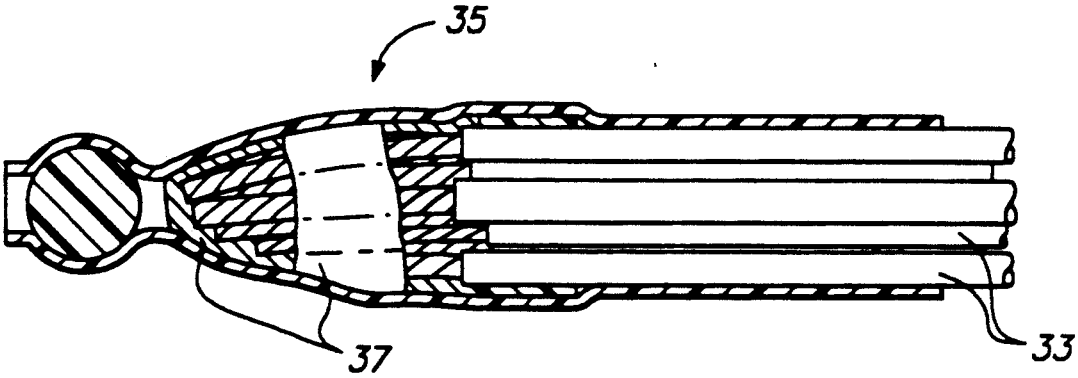
FIG. 6 is a sectional elevation along the axis of a solder connection between the wires, which has been formed by heating the temporary connection shown in FIG. 5.

FIGS. 5 and 6 illustrate the method of forming an electrical connection according to the invention. FIG. 5 shows the device of FIG. 3 and a plurality of stranded insulated electrical wires 33; a length of insulation has been stripped from one end of each wire and these ends of the wires have been inserted into the open end 14 of the heat-recoverable sleeve 2 and twisted into the connecting element 23 through its relatively wide open end 28, thereby forming a temporary electrical connection between the wires.

FIG. 6 shows a solder connection 35 between the wires 33 of FIG. 5 which has been formed by heating the device of FIG. 3 subsequent to the formation of the temporary electrical connection between the wires. Heating the device has caused the solder connecting element 23 to melt, the sleeve 2 to recover about the wires 33 and the fusible polymeric material 7 to fuse between the wires and the sleeve. The solder which has melted and then solidified is indicated 37.

What is claimed is:

1. A device for forming an electrical connection between a plurality of elongate electrical conductors, which comprises an electrically insulating sleeve and a hollow connecting element contained within the sleeve, the connecting element formed from solder for forming a solder connection between the conductors and having a tapering internal surface that is provided with a screw thread, arranged so that a temporary electrical connection between the conductors may be formed by twisting them into the connecting element.

2. A device as claimed in claim 1, wherein the screw thread is periodically interrupted along at least part of its length.

3. A device as claimed in claim 1, wherein the connecting element is formed from a tapering coil of solder wire.

4. A device as claimed in claim 1, wherein at least part of the sleeve is dimensionally heat-recoverable.

5. A device as claimed in claim 1, wherein the sleeve contains a quantity of fusible polymeric material.

6. A device as claimed in claim 3, wherein the screw thread of the connecting element is formed from at least one ridge extending along at least part of the length of the solder wire.

7. A device as claimed in claim 6, wherein at least part of the solder wire has a substantially polygonal cross-section.

8. A device as claimed in claim 3, wherein at least part of the solder wire is hollow along its length and contains a quantity of flux.

9. A device for forming an electrical connection between a plurality of elongate electrical conductors which comprises an electrically insulating sleeve and containing a hollow connecting element contained within the sleeve, the connecting element comprising a tapering coil of solder wire for forming a solder connection between the conductors, the solder wire having at least one ridge extending helically along at least part of its length, arranged so that a temporary electrical connection between the conductors may be formed by twisting them into the coil.

10. A device as claimed in claim 9, wherein at least part of the sleeve is dimensionally heat-recoverable.

11. A device as claimed in claim 9, wherein at least part of the solder wire has a substantially polygonal cross-section.

12. A device as claimed in claim 11, wherein the solder wire has a substantially rhombic cross-section.

13. A device as claimed in claim 9, wherein at least part of the solder wire is hollow along its length and contains a quantity of flux.

14. A device as claimed in 9, wherein the coil of the solder wire has opposite handedness to that of the helix or helices of the or each ridge extending along at least part of the length of the wire.

15. A device as claimed in claim 9, wherein the coil of solder wire tapers in two opposite directions to an intermediate region of minimum diameter.

16. A device as claimed in claim 9, which includes a second tapering coil of solder wire connected to the first coil of solder wire by connecting means.

17. A device as claimed in claim 9, wherein the sleeve contains a quantity of fusible polymeric material.

18. A method of forming an electrical connection between a plurality of elongate electrical conductors by means of a device comprising an electrically insulating sleeve and a hollow connecting element contained within the sleeve, the connecting element formed from solder, for forming a solder connection between the conductors and having a tapering internal surface that is provided with a screw thread, arranged so that a temporary electrical connection between the conductors may be formed by twisting them into the connecting element, the method comprising:

(a) twisting the elongate electrical conductors into the solder connecting element of the device, thereby forming a temporary electrical connection between the conductors;

(b) heating the device so that at least some of the solder of the connecting element melts; and (c) allowing the device to cool so that the molten solder solidifies and forms a solder connection between the conductors.

19. A method as claimed in claim 18, which includes passing an electrical current through the temporary electrical connection prior to heating the device.

* * * * *